US008582800B2

(12) United States Patent
Kim et al.

(10) Patent No.: US 8,582,800 B2
(45) Date of Patent: Nov. 12, 2013

(54) SLIM-TYPE SPEAKER WITH INTERCONNECTING DAMPER AND BOBBIN

(75) Inventors: Min Kim, Suwon-si (KR); Hag-do Kim, Suwon-si (KR); Sang-hun Jeon, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/343,342

(22) Filed: Jan. 4, 2012

(65) Prior Publication Data

US 2012/0170794 A1 Jul. 5, 2012

(30) Foreign Application Priority Data

Jan. 4, 2011 (KR) ..... 10-2011-0000534

(51) Int. Cl.
*H04R 9/06* (2006.01)
*H04R 11/02* (2006.01)

(52) U.S. Cl.
USPC ..... 381/413; 381/404

(58) Field of Classification Search
USPC ..... 381/404, 413
See application file for complete search history.

(56) References Cited

U.S. PATENT DOCUMENTS

| | | | | |
|---|---|---|---|---|
| 6,404,896 | B1 * | 6/2002 | Yoo et al. | 381/401 |
| 2002/0112914 | A1 * | 8/2002 | Abe et al. | 181/166 |
| 2005/0002541 | A1 * | 1/2005 | Killion et al. | 381/353 |
| 2007/0025585 | A1 * | 2/2007 | Ikeda et al. | 381/403 |

FOREIGN PATENT DOCUMENTS

| | | | |
|---|---|---|---|
| EP | 1750477 | A1 | 2/2007 |
| EP | 2180721 | A1 | 4/2010 |
| EP | 2262281 | A1 | 12/2010 |

OTHER PUBLICATIONS

Search Report issued Apr. 3, 2012 by the European Patent Office in counterpart European Application No. 11183526.0.

* cited by examiner

*Primary Examiner* — Brian Ensey
*Assistant Examiner* — Katherine Faley
(74) *Attorney, Agent, or Firm* — Sughrue Mion, PLLC

(57) ABSTRACT

A speaker includes a frame, a diaphragm disposed in a top end of the frame of the speaker and a bobbin disposed below the diaphragm. A voice coil is wound around a bottom end of the bobbin and a magnetic member, which has a groove in which the bottom end of the bobbin around which the voice coil is wound, is inserted and reciprocated in a straight line upward and downward. A central pillar is fixed to the magnetic member at a center of the bobbin and extends parallel to the movement of the bobbin. A damper supports an inner circumferential surface of the bobbin from the central pillar. The damper additionally supports an outer circumferential surface of the bobbin, from the frame, so as to allow the bobbin to reciprocate in a straight line. This results in minimization of wobble and distortion, so that accurate sound is generated.

14 Claims, 8 Drawing Sheets

SLIM-TYPE SPEAKER WITH INTERCONNECTING DAMPER AND BOBBIN

CROSS-REFERENCE TO RELATED APPLICATIONS

This application claims the benefit under 35 U.S.C. §119 (a) from Korean Patent Application No. 10-2011-0000534 filed Jan. 4, 2011 in the Korean Intellectual Property Office, the disclosure of which is incorporated herein by reference in its entirety.

BACKGROUND

1. Field

The present inventive concept relates to a speaker. More particularly, the present inventive concept relates to a structure supporting a voice coil of a slim-type speaker.

2. Description of the Related Art

A speaker is an electro acoustic transducer and generally has a supporting structure which supports the linear reciprocating motion of a voice coil. The supporting structure is disposed in order for the voice coil to maintain linearity at a center thereof while the voice coil performs linear reciprocating motion or piston motion. The supporting structure may include dampers (or spiders), edges (or surrounds), etc.

The slim-type speaker is a speaker of a shape having a cross-section of which the width is smaller than the length, and may be designed to have a diaphragm of an elongated circular shape, an ellipse shape or a rectangular shape, but not a circular shape. If the diaphragm of the speaker is in the form of an elongated circular shape, an ellipse shape or a rectangular shape, there is a limitation as to the area and/or shape of a damper that connects to a bobbin of the voice coil and connects to a frame of the speaker, and maintains position in the center of the voice coil.

FIGS. 1 and 2 illustrate related art slim-type speakers. FIG. 1 is a sectional view schematically illustrating a slim-type speaker of related art. FIG. 2 is a plan view illustrating the slim-type speaker of FIG. 1, after removing a diaphragm.

Referring to FIGS. 1 and 2, a damper 101 is formed with a horizontally long shape and is fixed in order to connect a portion of a bobbin 105 of a voice coil 103 and a frame 110. As illustrated in FIGS. 1 and 2, bobbin 105 is stably supported in a long-axis direction (an X direction) of the speaker 100 by a long-axis damper 101 disposed in a horizontal direction. However, since damper 101 cannot be disposed in a short-axis direction (a Y direction) of speaker 100, namely, in a vertical direction, bobbin 105 is supported in the short-axis direction of the speaker 100 by dampers 107 disposed in the horizontal direction. Therefore, bobbin 105 is supported less stably in the short-axis direction than in the long-axis direction of speaker 100. Although not illustrated, if no damper is disposed for supporting bobbin 105 in the short-axis direction of speaker 100, the support of bobbin 105 becomes more unstable.

The supporting method as described above makes it difficult to support bobbin 105, around which voice coil 103 is wound, by the same supporting force with respect to a center point thereof. If the supporting force of bobbin 105 is not uniform, when voice coil 103 reciprocates in a vertical direction, different size forces may be applied to portions of dampers 101 and 107 which are adhered to bobbin 105 of voice coil 103. This results in voice coil 103 generating wobble, resulting in an increase in distortion near a resonance frequency having relatively broad amplitude.

In other words, if dampers 101 and 107 are designed to have an asymmetrical shape with respect to the center of speaker 100, nonlinear motion of voice coil 103 may occur. If voice coil 103 moves nonlinearly, wobble and/or distortion in sound produced by speaker 100 may be increased.

Therefore, proper operation of a slim-type speaker 100 requires dampers formed symmetrically with respect to the center of speaker 100.

SUMMARY

The present inventive concept has been developed in order to overcome the above drawbacks and other problems associated with the arrangements known in the related art. An aspect of the present inventive concept relates to a speaker having a damper capable of supporting, by a uniform force, a bobbin of a voice coil with respect to a center thereof, in order to reduce wobble or/and distortion in a slim-type speaker.

An aspect of the exemplary embodiments relates to a speaker assembling method, including a method of assembling a bobbin and a damper to form a bobbin-damper assembly used in a slim-type speaker.

The above aspect and/or other feature of the exemplary embodiments can be substantially achieved by providing a speaker, which includes a frame; a diaphragm disposed in a top end of the frame; a bobbin disposed below the diaphragm, a voice coil wound around the bottom of the bobbin; a magnetic member having a groove in which the bottom end of the bobbin, around which the voice coil is wound, is inserted and the bobbin and voice coil are reciprocated upward and downward in a straight line; a central pillar fixed to the magnetic member in a center of the bobbin parallel to the bobbin; and a damper which supports an inner circumferential surface of the bobbin from the central pillar and supports an outer circumferential surface of the bobbin from the frame, so as to allow the bobbin to reciprocate in a straight line.

The damper may include an outer damper secured to the frame, the outer damper supporting the outer circumferential surface of the bobbin. An inner damper is secured to the central pillar and supports the inner circumferential surface of the bobbin.

The outer damper may include a first outer damper which is secured in order to surround some portion of the outer circumferential surface of the bobbin. A second outer damper, which is spaced apart from the first outer damper, is secured in order to surround a rest portion of the outer circumferential surface of the bobbin.

The inner damper may be formed as a single body with any one or both of the first and second outer dampers.

The outer damper and the inner damper may be connected to each other by a bridge, and by a fixing groove formed on the bobbin, in which the bridge is inserted.

An end of the voice coil may be electrically connected to the first outer damper. The other end of the voice coil may be electrically connected to the second outer damper.

The first and second outer dampers may be connected by a joint portion in order to form a single body. After the first and second outer dampers, formed in a single body, are assembled to the bobbin, the joint portion is cut so that the first and second outer dampers are electrically insulated from each other.

The inner damper may include two supporting arms formed symmetrically from the central pillar.

The outer damper may be formed symmetrically with respect to a straight line passing the central pillar. The damper may be formed as a conductor.

The frame has a cross-section in which a length is longer than a width.

At least two bobbins, magnetic members, central pillars, and dampers may be disposed in the frame below the diaphragm.

According to another aspect of the exemplary embodiments, a method of assembling a speaker may include: preparing a bobbin around which a voice coil is wound and preparing a damper including first and second outer dampers and an inner damper formed in a single body; inserting the damper into the bobbin; adhering the first and second outer damper to an outer circumferential surface of the bobbin and adhering the inner damper to an inner circumferential surface of the bobbin; and cutting a joint portion of the first and second outer dampers so that the first and second dampers are spaced apart from each other by a predetermined distance.

When inserting the damper into the bobbin, a bridge of the damper may be inserted into a fixing groove of the bobbin.

The method of assembling the speaker may include assembling a central pillar in a center hole of the inner damper before inserting the damper into the bobbin.

Other objects, advantages and salient features of the exemplary embodiments will become apparent from the following detailed description, which, taken in conjunction with the annexed drawings, discloses exemplary embodiments of the inventive concept.

BRIEF DESCRIPTION OF THE DRAWINGS

These and/or other aspects and advantages of the inventive concept will become apparent and more readily appreciated from the following description of the exemplary embodiments, taken in conjunction with the accompanying drawings in which.

Throughout the drawings, like reference numerals will be understood to refer to like parts, components and structures.

DETAILED DESCRIPTION OF THE EXEMPLARY EMBODIMENTS

Hereinafter, certain exemplary embodiments will be described in detail with reference to the accompanying drawings.

The matters defined in the description, such as a detailed construction and elements thereof, are provided to assist in a comprehensive understanding of the inventive concept. Thus, it is apparent that the exemplary embodiments may be carried out without those matters defined by the exemplary embodiments. Also, well-known functions or constructions are omitted in order to provide a clear and concise description of the exemplary embodiments. Further, dimensions of various elements in the accompanying drawings may be arbitrarily increased or decreased in order to assist in a comprehensive understanding of the exemplary embodiments.

Figure 1:
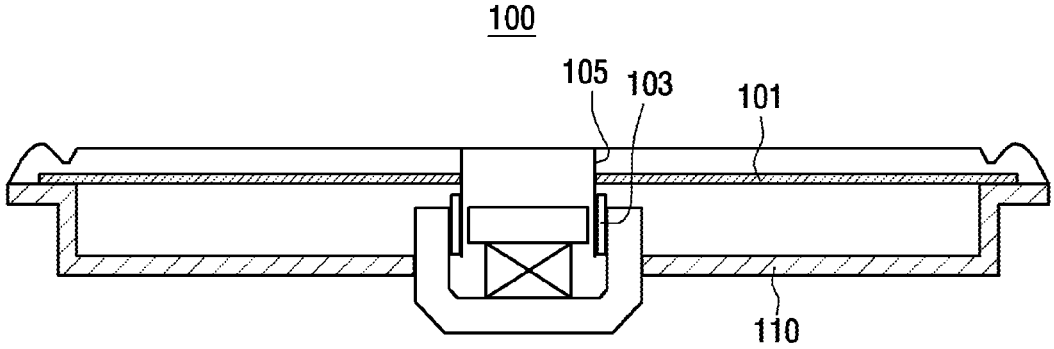
FIG. 1 (RELATED ART)
FIG. 1 is a sectional view schematically illustrating a slim-type speaker in the related art.
Figure 2:
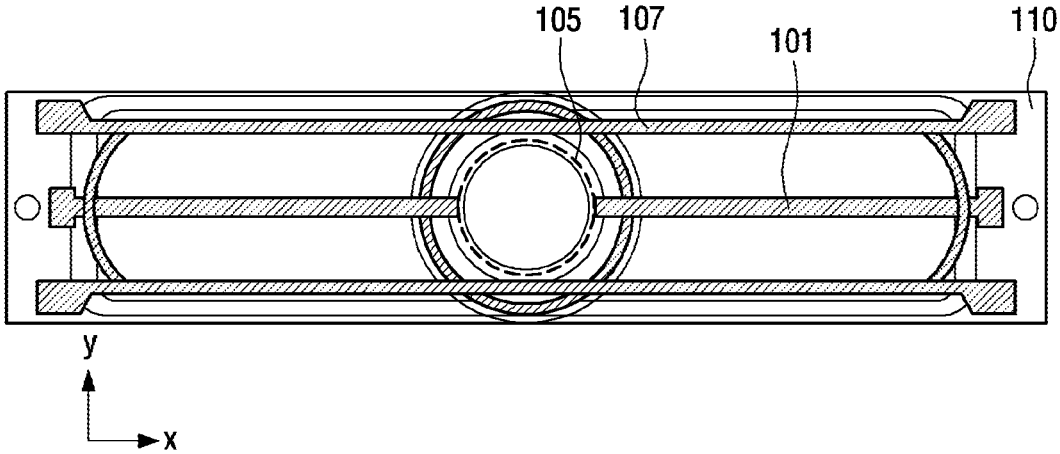
FIG. 2 (RELATED ART)
FIG. 2 is a plan view illustrating the slim-type speaker of FIG. 1 after removing a diaphragm.
Figure 3:
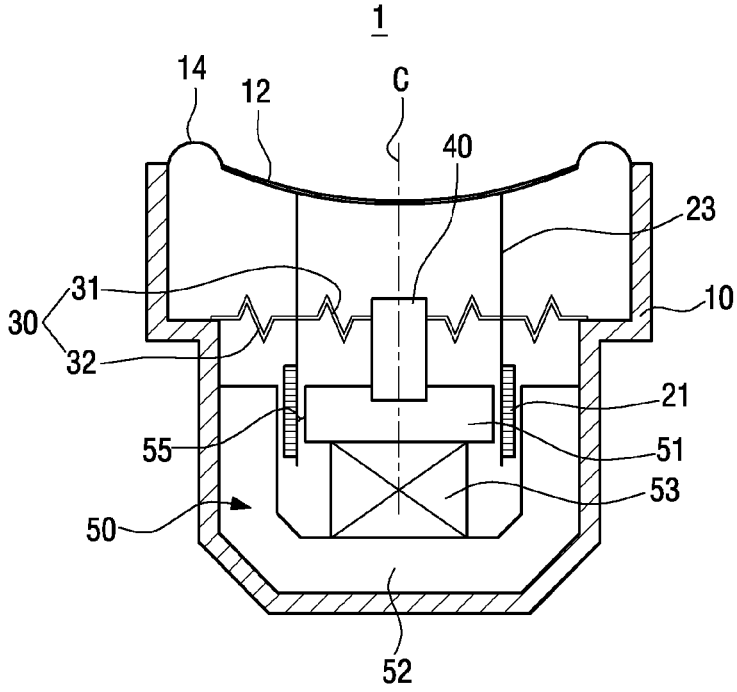
FIG. 3 is a sectional view which conceptually illustrates a speaker, according to an exemplary embodiment.

FIG. 3 is a sectional view conceptually illustrating a speaker 1 according to an exemplary embodiment.

Referring to FIG. 3, speaker 1 is provided with a damper 30 supporting both an inside and an outside of bobbin 23, in order to provide a supporting force which is symmetrical with respect to a center of the speaker 1, i.e., a center C of bobbin 23 around which a voice coil 21 is wound. In other words, a central pillar 40, which is fixed to a magnetic member 50, is disposed at the center C of bobbin 23. An inner damper 31, is disposed for supporting an inner surface of bobbin 23 from central pillar 40. An outer damper 32 is disposed for supporting an outer surface of bobbin 23 from a frame 10. Therefore, since speaker 1 can support bobbin 23, around which voice coil 21 is wound symmetrically with respect to the center C of bobbin 23, bobbin 23 can be vertically reciprocated in a straight line by a magnetic circuit formed in magnetic member 50.

Magnetic member 50 forms a magnetic circuit in order to allow bobbin 23, around which voice coil 21 is wound, to reciprocate vertically in a straight line. Magnetic member 50 may include an inner yoke 51 in which central pillar 40 is disposed. A permanent magnet 53 is disposed below inner yoke 51, and an outer yoke 52 is disposed below permanent magnet 53. Outer yoke 52 surrounds the permanent magnet 53 and inner yoke 51. Between inner yoke 51 and outer yoke 52 a groove is formed, i.e., an air gap 55 in which voice coil 21, wound around bobbin 23, is inserted and can move upward and downward.

Reference numeral 12 of FIG. 3, not explained above, is a diaphragm that is oscillated by bobbin 23 to generate sound. Reference numeral 14 represents an edge supporting diaphragm 12 with respect to frame 10.

Figure 4:
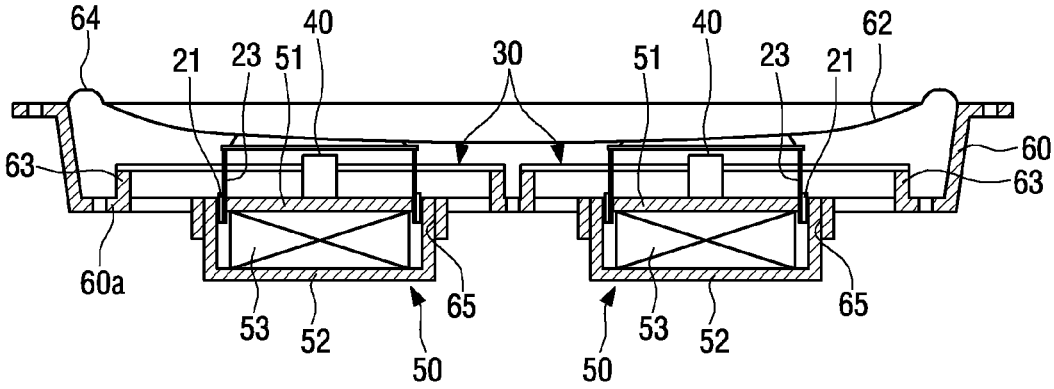
FIG. 4 is a sectional view which schematically illustrates a speaker, according to an exemplary embodiment.
Figure 5:
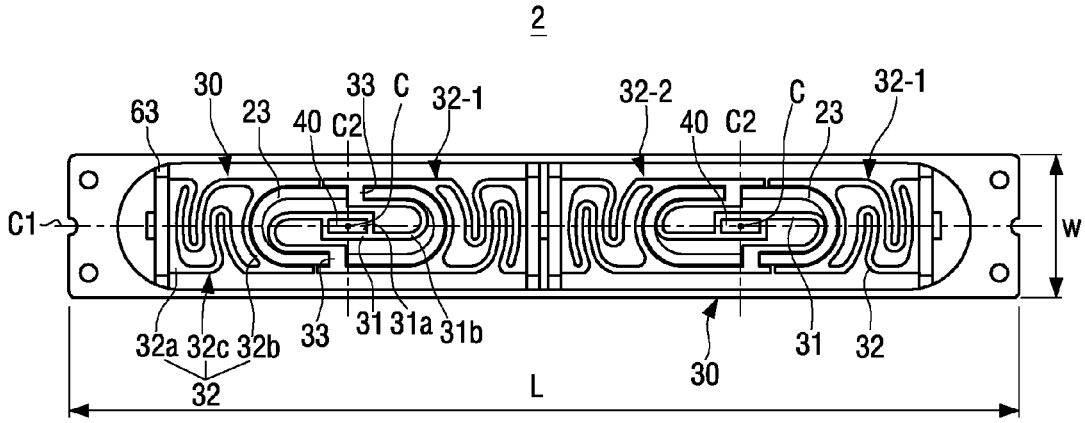
FIG. 5 is a plan view illustrating the speaker of FIG. 4 after removing a diaphragm.
Figure 6:
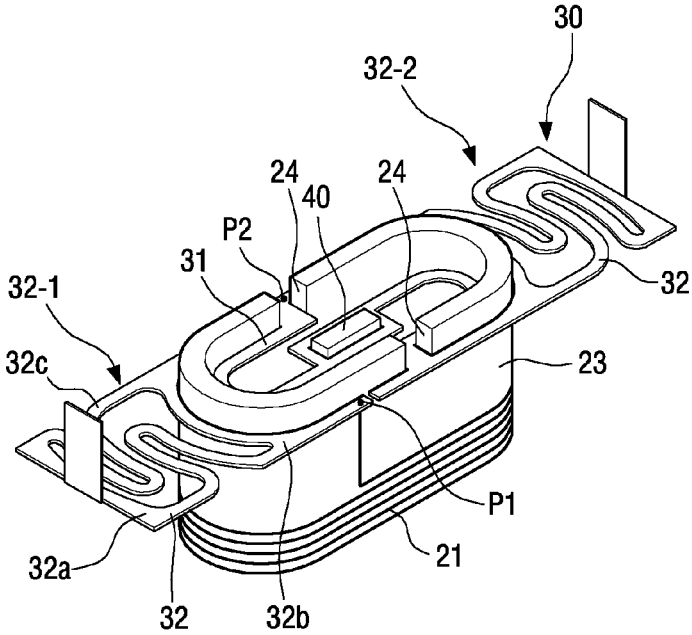
FIG. 6 is a perspective view illustrating a bobbin-damper assembly of the speaker of FIG. 4.

FIG. 4 is a sectional view schematically illustrating a speaker 2 according to an exemplary embodiment. FIG. 5 is a plan view illustrating the speaker 2 of FIG. 4, after removing diaphragm 12. FIG. 6 is a perspective view illustrating a bobbin-damper assembly of speaker 2 as illustrated in FIG. 4.

Referring to FIGS. 4 and 5, speaker 2, according to an exemplary embodiment is a slim-type speaker having two voice coils 21. Here, the slim-type speaker 2, as illustrated in FIG. 5, refers to a speaker having a top surface of which length L is larger than width W. Therefore, in slim-type speaker 2, a center axis of a lengthwise direction is referred as a long-axis C1, and an axis perpendicular to the long-axis C1 as a center axis of a widthwise direction is referred as a short-axis C2. In addition, FIG. 5 illustrates speaker 2 having a top surface formed in a rectangular shape. However, this is only one example and should not be considered as limiting. The top surface of speaker 2 may be formed in an elongated circular shape (or a playground shape), an ellipse shape, etc.

Referring to FIGS. 4 and 5, speaker 2 according to an exemplary embodiment may include a frame 60, a diaphragm 62, a bobbin 23, a voice coil 21, a central pillar 40, a damper 30, and a magnetic member 50.

Frame 60 represents an outer appearance of speaker 2 and is formed as a hollow container having a bottom surface **60*a*** in a slim shape. On bottom surface 60*a* of frame 60 two holes 65 are formed in which two magnetic members 50 are disposed. The two holes 65 are spaced apart from each other at a predetermined distance. Also, a supporting portion 63 supporting damper 30 projects around each of holes 65 from bottom surface 60*a*. In this exemplary embodiment, frame 60 is formed in which two magnetic members 50 are disposed. However, this is only one example. Frame 60 may be formed in which one magnetic member 50, or three or more magnetic members 50 are disposed when necessary.

The diaphragm 62 moves in a position corresponding to the motion of the bobbin in order to generate a longitudinal wave, thereby producing sound. All of the circumference of the diaphragm 62 is secured to a top end of frame 60 by an edge (or surround) 64. Diaphragm 62 may be formed of cotton, press-molded sponge, rubber, compound material, etc. A bass limit frequency of speaker 2 may be changed by the weight and cross-sectional shape of diaphragm 62.

Figure 7:
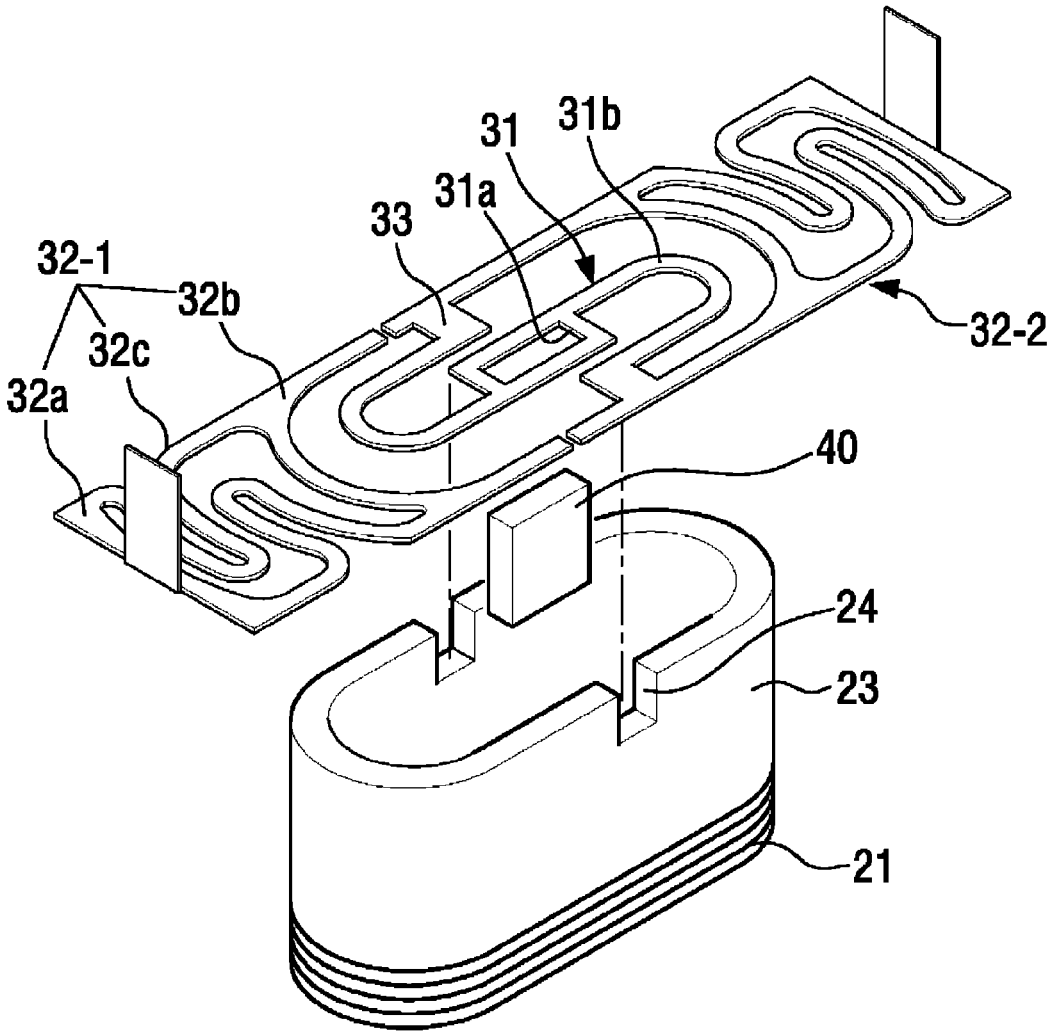
FIG. 7 is an exploded perspective view illustrating the bobbin-damper assembly of FIG. 6.

Bobbin 23 is disposed below the diaphragm 62 and is formed in the shape of a hollow pipe. A first end of the bobbin 23 is fixed to diaphragm 62 and near a second end of bobbin 23 is wound by voice coil 21. Bobbin 23 may have a cross-section shape of a circle, an elongated circle, etc. Referring to FIGS. 6 and 7, in this embodiment, bobbin 23 is formed to have an elongated circular cross-section. On the first end of bobbin 23, to which diaphragm 62 is adhered, two fixing grooves 24 are formed for defining a position of damper 30.

Voice coil 21 is wound around the second end of bobbin 23 so that voice coil 21 can reciprocate in a straight line along with bobbin 23. Voice coil 21 is electrically connected with an electronic circuit (not illustrated) in order to output a voice signal via damper 30. Therefore, the voice signal output from the electronic circuit flows through voice coil 21.

Central pillar 40 is fixed to magnetic member 50 in the center of bobbin 23. Central pillar 40 is parallel to bobbin 23, in order to support damper 30. Therefore, a bottom end of central pillar 40 may be fixed to a top portion of magnetic member 50, i.e., first yoke 51, by various methods. For example, after machining a hole in magnetic member 50, central pillar 40 may be inserted into and fixed to the hole. The bottom end of central pillar 40 is adhered to magnetic member 50 using an adhesive. As an alternative, central pillar 40 may be secured to magnetic member 50 through the use of screws.

Damper 30 supports bobbin 23 so that bobbin 23 can reciprocate in a straight line, in a direction perpendicular to bottom surface 60*a* of frame 60. Opposite ends of bobbin 23 are fixed to supporting portions 63 formed on bottom surface 60*a* of frame 60. Bobbin 23 is fixed to the center of damper 30.

In this embodiment, damper 30 is designed to uniformly support bobbin 30 symmetrically with respect to the center C of bobbin 23 in the slim-type speaker 2. In other words, damper 30 is formed to support the bobbin 23 by a uniform force in long-axis direction C1 and also in short-axis direction C2 of slim-type speaker 2. Damper 30 is formed to have an outer damper 32 and an inner damper 31. Outer damper 32 supports bobbin 23 from the outside of bobbin 23. Outer damper 32 supports bobbin 23 mainly in the long-axis direction C1 of speaker 2. Therefore, outer damper 32 surrounds an outer circumferential surface of bobbin 23. The opposite ends of outer damper 32 are fixed to supporting portion 63 of frame 60. Inner damper 31 supports bobbin 23 from the inside of bobbin 23. Inner damper 31 supports bobbin 23 mainly in the short-axis direction C2 of the speaker 2. Therefore, an end of inner damper 31 is fixed to an inner circumferential surface of bobbin 23, and the other end of inner damper 31 is fixed to central pillar 40. Also, inner damper 31 and outer damper 32 may be formed to have a shape symmetric with respect to the center of bobbin 23. In this exemplary embodiment, outer damper 32 is formed to be symmetric with respect to center axis C2 of the short-axis direction of bobbin 23. Inner damper 31 is formed in a symmetrical shape with respect to center C of bobbin 23.

In addition, outer damper 32 may be divided into two parts, i.e., a first outer damper 32-1 and a second outer damper 32-2. In other words, first outer damper 32-1 is formed so that an end thereof surrounds a portion of the outer circumferential surface of bobbin 23 and the other end thereof is fixed to supporting portion 63. Second outer damper 32-2 is formed so that an end thereof is spaced apart from first outer damper 32-1 and surrounds a rest portion of the outer circumferential surface of bobbin 23 and the other end of thereof is fixed to supporting portion 63. As described above, in response to outer damper 32 being divided into two parts in order to form first and second outer dampers 32-1 and 32-2, outer damper 32 can be used as a terminal for applying a voice signal to voice coil 21. In other words, as illustrated in FIG. 6, a first end of voice coil 21 is soldered to P1 of the first outer damper 32-1, and a second end of voice coil 21 is soldered to P2 of the second outer damper 32-2.

For convenience of assembly of damper 30 and bobbin 23, inner damper 31 and outer damper 32 may be formed as a single body. In this exemplary embodiment, second outer damper 32-2 and inner damper 31 are formed as a single body Inner damper 31 and second outer damper 32-2 are connected with each other through two bridges 33. In a center of inner damper 31 a center hole 31*a* is formed in which central pillar 40 is fixed thereto. Two supporting arms 31*b* extend from center hole 31*a*. After supporting arm 31*b* extends from center hole 31*a* to the inner circumferential surface of the bobbin 23, supporting arm 31*b* is formed so as to contact along a predetermined length of the inner circumferential surface of bobbin 23 and connect with bridge 33. The two supporting arms 31*b* are formed to be at a point of symmetry with respect to center C of center hole 31*a*. Each of supporting arms 31*b* is formed to contact approximately ¼ of the inner circumferential surface of bobbin 23. Supporting arms 31*b* are adhered to the inner circumferential surface of bobbin 23 by an adhesive.

Figure 10:
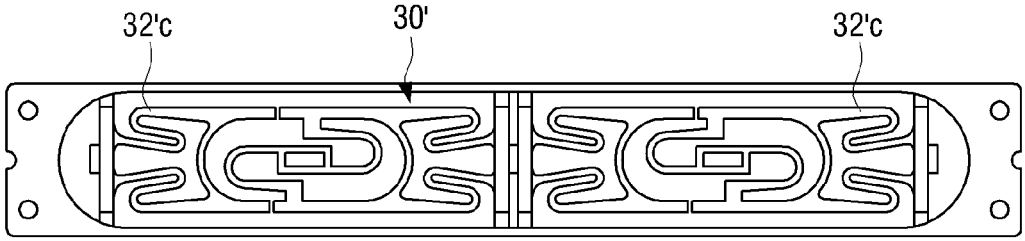
FIG. 10 is a plan view illustrating another damper that can be used in a speaker according to an exemplary embodiment.

First and second outer dampers 32-1 and 32-2 include a bobbin contact portion 32*b* which contacts the outer circumferential surface of bobbin 23 and a frame securing portion 32*a* to be fixed to supporting portion 63 of frame 60. Also, first and second outer dampers 32-1 and 32-2 include a connecting portion 32*c* which connect bobbin contact portion 32*b* and frame securing portion 32*a*. Bobbin contact portion 32*b* and frame securing portion 32*a* are formed in a shape corresponding to a shape of each of bobbin 23 and frame 60. Bobbin contact portion 32*b* is adhered to the outer circumferential surface of the bobbin 23 by an adhesive. Frame securing portion 32*a* is adhered to supporting portion 63 of frame 60 by the adhesive. Connecting portion 32*c* may be formed in various shapes so long as connecting portion 32*c* can connect bobbin contact portion 32*b*, and frame securing portion 32*a* and can support linear reciprocation of bobbin 23. FIG. 10 illustrates another exemplary embodiment of a damper 30' having a connecting portion 32*c'* of a shape that is different from connecting portion 32*c* of damper 30, as illustrated in FIG. 5.

Figure 8:
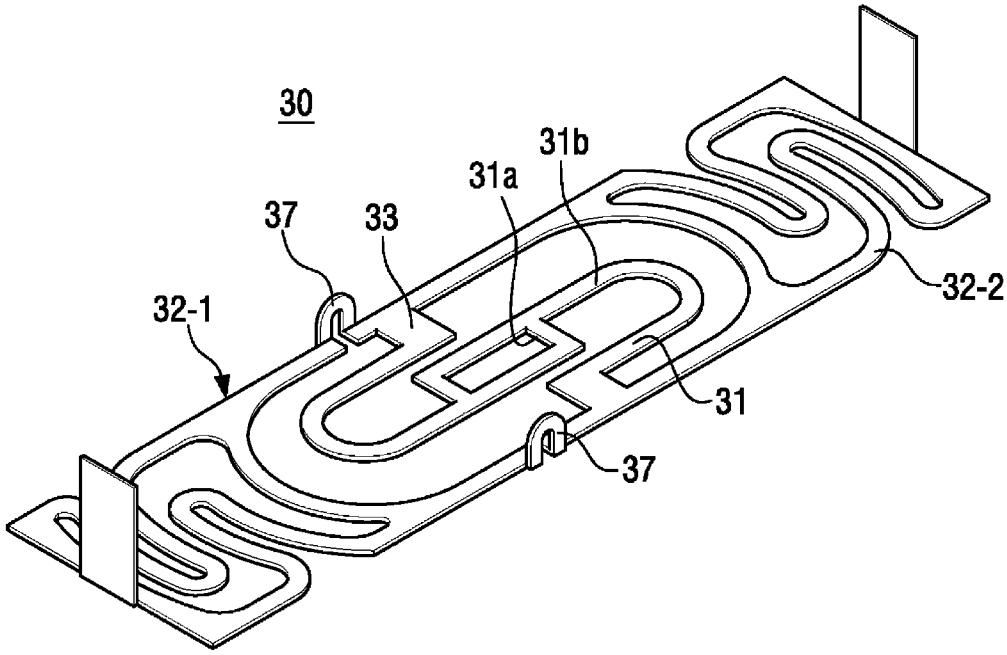
FIG. 8 is a perspective view illustrating a single body damper before assembled to the bobbin as illustrated in FIG. 6.
Figure 9:
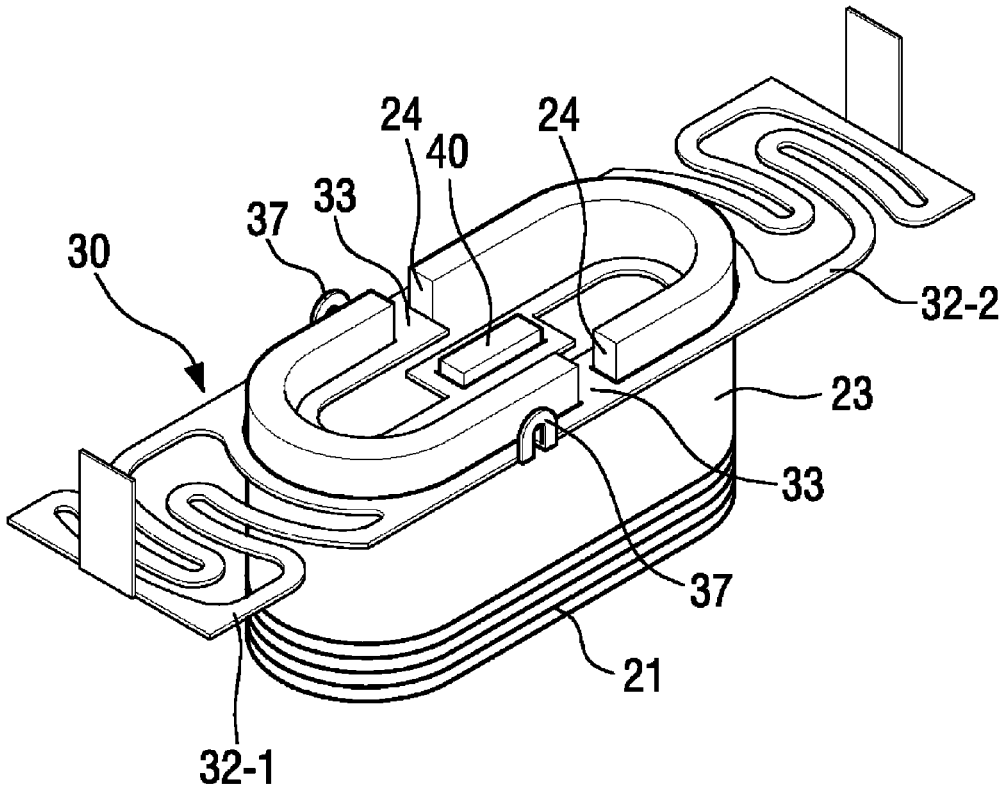
FIG. 9 is a perspective view illustrating the damper of FIG. 8 assembled to the bobbin.

Further, for convenience of manufacturing and assembly, first and second outer dampers 32-1 and 32-2 may be formed as a single outer damper 32. In other words, as illustrated in FIG. 8, first and second outer dampers 32-1 and 32-2 may be formed in a single body connected by a joint portion 37. Therefore, in this exemplary embodiment, first and second outer dampers 32-1 and 32-2 and inner damper 31 may be integrally formed as a single piece. Joint portion 37 may be cut after damper 30 is assembled to bobbin 23. Then first and second outer dampers 32-1 and 32-2 are not connected but rather are spaced apart from each other so that first and second outer dampers 32-1 and 32-2 are electrically insulated. As a result, a voice signal can be transmitted to voice coil 21 through first and second outer dampers 32-1 and 32-2.

Damper 30 may be formed of hemp, cotton, conex, Kevlar, rubber, mixture thereof, or nonferrous metals alloy, etc. Also, damper 30 may be formed of a conductor. Frequency response characteristic of speaker 2 may be changed by area, weight, elasticity, etc. of damper 30.

Magnetic member 50 is disposed below bobbin 23 and forms a magnetic circuit capable of moving voice coil 21 according to a voice signal flowing through voice coil 21. Referring to FIGS. 3 and 4, magnetic member 50 includes first yoke 51 formed to have a shape corresponding to the cross-section of bobbin 23, the second yoke 52 formed to surround first yoke 51, and the permanent magnet 53 disposed between the bottom of first yoke 51 and the top of second yoke 52. Second yoke 52 is spaced apart from first yoke 51 by a predetermined distance in order to form an air gap 55 in which the bottom end of bobbin 23 is inserted and moves. Permanent magnet 53 forms a magnetic field in air gap 55 between first and second yokes 51 and 52. Therefore, bobbin 23 can be moved upward and downward with respect to magnetic member 50 in which to correspond to a change in the voice signal flowing through voice coil 21, which is wound around bobbin 23.

Figure 11:
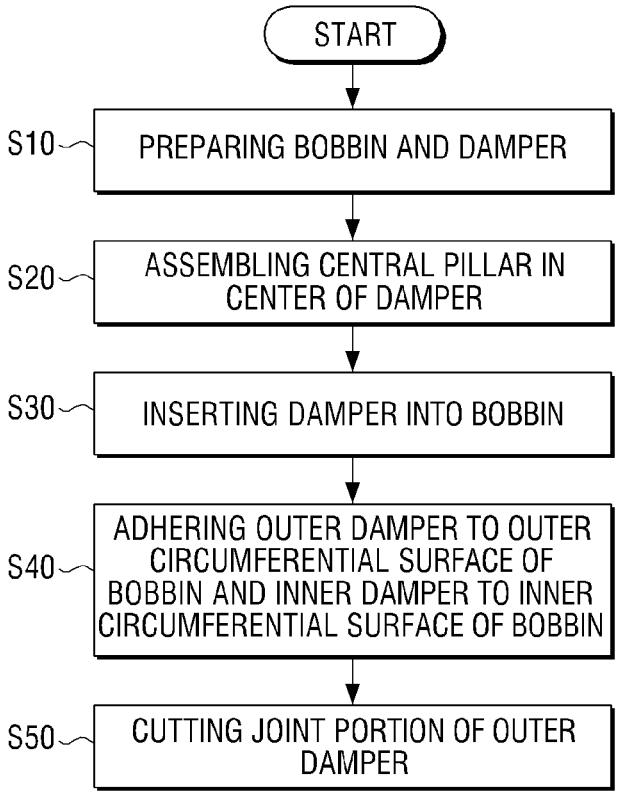
FIG. 11 is a flow chart illustrating a method of assembling a speaker according to an exemplary embodiment.

Hereinafter, an assembling method of slim-type speaker 2 having the above-described structure will be explained in detail with reference to FIG. 11.

First, bobbin 23, around which voice coil 21 is wound, and damper 30 of which first and second outer dampers 32-1 and 32-2 and inner damper 31 are formed in a single body, are prepared (S10).

Then, central pillar 40 is assembled in center hole 31*a* of damper 30 (S20). Central pillar 40 may be secured to center hole 31*a* of damper 30 using the adhesive.

Thereafter, damper 30 is inserted into bobbin 23 (S30). At this time, bridge 33 of damper 30 is inserted into fixing groove 24 of bobbin 23 so that damper 30 is fixed to a predetermined position of bobbin 23.

Next, the outer circumferential surface of bobbin 23 and outer damper 32 are adhered to each other using the adhesive Inner damper 31 is adhered to the inner circumferential surface of bobbin 23 (S40).

After outer damper 32 and inner damper 31 are fixed to bobbin 23, joint portion 37 of outer damper 32 is cut (S50). Then, first and second outer dampers 32-1 and 32-2 are spaced apart by a predetermined distance from each other. This completes the assembly of an exemplary embodiment of a bobbin-damper assembly.

In addition, similar to the assembly of a speaker in the related art, magnetic member 50, bobbin-damper assembly and diaphragm 62 are, in order, assembled to frame 60 in order to complete speaker 2. At this time, when the bobbin-damper assembly is disposed in magnetic member 50, the bottom end of central pillar 40, which is assembled at the center of the bobbin-damper assembly, may be coated by the adhesive to be secured to first yoke 51 of magnetic member 50.

Hereinafter, operation of slim-type speaker 2 according to an exemplary embodiment having the structure as described above will be explained with reference to accompanying figures.

The bottom end of bobbin 23, around which voice coil 21 is wound, is located in air gap 55 of the magnetic circuit configured with respect to first yoke 51, second yoke 52, and permanent magnet 53 of magnetic member 50. In this state, when a voice signal converted into a current is applied to voice coil 21, voice coil 21 is reciprocated in a straight line in a vertical direction, that is, in a direction perpendicular to bottom surface 60*a* of frame 60, according to Fleming's left hand rule.

At this time, bobbin 23 transmits the generated kinetic energy to diaphragm 62 so as to form air particles into longitudinal wave. Then, sound corresponding to the voice signal is generated by diaphragm 62.

With the speaker according to an exemplary embodiment, inner damper 31, which is symmetrically disposed inside bobbin 23, around which voice coil 21 is wound, supports bobbin 23 in the short-axis direction. Outer damper 32, which is symmetrically disposed outside bobbin 23, supports bobbin 23 in the long-axis direction. As a result, bobbin 23 is supported by an uniform force in a circumferential direction from the center C of bobbin 23. Accordingly, in slim-type speaker 2, wobble and distortion are minimized, resulting in the generation of accurate sound.

Figure 12:
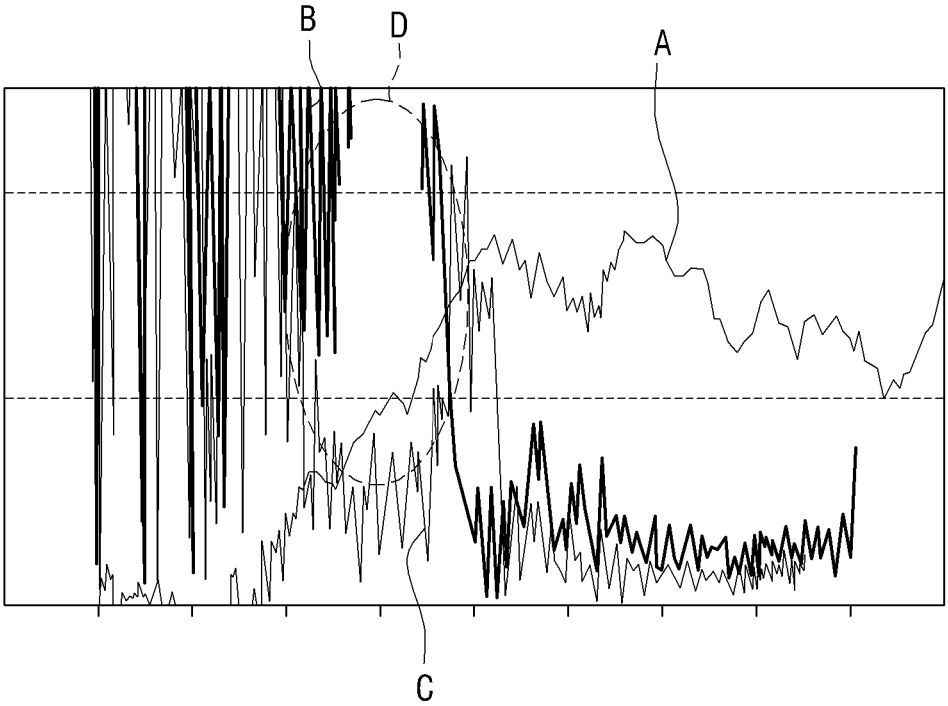
FIG. 12 is a graph illustrating a decreasing effect of total harmonic distortion (THD) in a speaker of an exemplary embodiment.

FIG. 12 is a graph illustrating decrease in THD in speaker 2, according to an exemplary embodiment having the structure as described above.

In FIG. 12, a graph A represents a sound generated by a voice signal entering speaker 2. Graphs B and C represent noises included in the sound produced by speaker 2, and are enlarged in scale. Graph B represents noise included in the sound produced by a speaker in the related art. Graph C represents noise included in the sound produced by the speaker 2 according to an exemplary embodiment. Referring to a region D illustrated by a dotted line in FIG. 12, it is found that the distortion in graph C is much lower than the distortion in graph B. Therefore, it has been found that speaker 2 according to an exemplary embodiment has less THD than the speaker of the related art.

While exemplary embodiments of the present invention have been described, additional variations and modifications of the exemplary embodiments may occur to those skilled in the art once they have learned the basic inventive concepts. Therefore, it is intended that the appended claims shall be construed to include both the above exemplary embodiments and all such variations and modifications that fall within the spirit and scope of the invention, as recited in the claims.

What is claimed is:

1. A speaker comprising:

a frame;

a diaphragm disposed in a top end of the frame;

a bobbin disposed below the diaphragm;

a voice coil wound around a bottom end of the bobbin;

a magnetic member having a groove, the bottom end of the bobbin, around which the voice coil is wound, being inserted and reciprocated in a straight line upward and downward in the groove;

a central pillar fixed to the magnetic member in a location at a center of the bobbin and extending parallel to the bobbin; and a damper which supports an inner circumferential surface of the bobbin and extends outwardly from the central pillar;

wherein the damper comprises;

an outer damper secured to the frame and supporting the outer circumferential surface of the bobbin; and an inner damper secured to the central pillar and supporting the inner circumferential surface of the bobbin, and wherein the outer damper and the inner damper are connected with each other by a bridge, and a fixing groove is formed on the bobbin in which the bridge is inserted, and the damper supports an outer circumferential surface of the bobbin from the frame so that the bobbin reciprocates in a straight line.

2. The speaker of claim 1, wherein the outer damper comprises;

a first outer damper secured to surround a portion of the outer circumferential surface of the bobbin; and a second outer damper which is spaced apart from the first outer damper and is secured to surround a remaining portion of the outer circumferential surface of the bobbin.

3. The speaker of claim 2, wherein the inner damper is formed in a single body with any one of the first and second outer dampers.

4. The speaker of claim 2, wherein an end of the voice coil is electrically connected to the first outer damper and the other end of the voice coil is electrically connected to the second outer damper.

5. The speaker of claim 2, wherein the first and second outer dampers are connected by a joint portion to form a single body, and wherein after the first and second outer dampers formed in a single body is assembled to the bobbin, the joint portion is cut so that the first and second outer dampers are electrically insulated from each other.

6. The speaker of claim 1, wherein the inner damper includes two supporting arms formed symmetrically from the central pillar.

7. The speaker of claim 1, wherein the outer damper is formed symmetrically with respect to a straight line passing through the central pillar.

8. The speaker of claim 1, wherein the damper is formed of a conductor.

9. The speaker of claim 1, wherein the frame has a cross-section in which a length is longer than a width.

10. The speaker of claim 9, further comprising: at least two bobbins, magnetic members, central pillars, and dampers which are disposed in the frame below the diaphragm.

11. A method of assembling a speaker, comprising:

preparing a bobbin around which a voice coil is wound and preparing a damper including first and second outer dampers and an inner damper formed in a single body;

inserting the damper into the bobbin;

adhering the first and second outer dampers to an outer circumferential surface of the bobbin and adhering the inner damper to an inner circumferential surface of the bobbin; and cutting a joint portion of the first and second outer dampers so that the first and second dampers are spaced apart from each other by a predetermined distance, and wherein when inserting the damper into the bobbin, a bridge of the damper is inserted into a fixing groove of the bobbin.

12. The method of claim 11, further comprising:

assembling a central pillar in a center hole of the inner damper before inserting the damper into the bobbin.

13. A damper for a speaker comprising:

a damper configured to be supported on a bobbin having a center pillar which is located at a center of the bobbin and a voice coil attached to a bottom portion of the bobbin;

wherein the damper is configured to be in contact with the central pillar of the bobbin and is formed symmetrically with a center of a speaker;

the damper supports an inner circumferential surface of the bobbin and extends outwardly from the central pillar; and the damper supports an outer circumferential surface of the bobbin from the frame so that the bobbin reciprocates in a straight line; and wherein the damper is configured to support the bobbin by a uniform force in both a longitudinal and width direction, so that wobble and distortion are minimized, resulting in a speaker which produces accurate sound, and wherein the damper comprises;

an outer damper secured to the frame and supporting the outer circumferential surface of the bobbin; and an inner damper secured to the central pillar and supporting the inner circumferential surface of the bobbin, and wherein the outer damper and the inner damper are connected with each other by a bridge, and a fixing groove is formed on the bobbin in which the bridge is inserted.

14. A method of assembling a damper for a speaker, the method comprising:

preparing a damper including first and second outer dampers and an inner damper formed in a single body, where the first and second outer dampers have a joint portion therebetween;

preparing a bobbin around which a voice coil is wound;

inserting the damper onto the bobbin;

when inserting the damper into the bobbin, a bridge of the damper is inserted into a fixing groove of the bobbin;

adhering the first and second outer dampers to an outer circumferential surface of the bobbin and adhering the inner damper to an inner circumferential surface of the bobbin; and cutting the joint portion of the first and second outer dampers so that the first and second outer dampers are spaced apart from each other by a predetermined distance.

* * * * *